US006415757B1

(12) United States Patent
Glovatsky

(10) Patent No.: US 6,415,757 B1
(45) Date of Patent: Jul. 9, 2002

(54) FLUID-COOLED HEAT SHIELD FOR TEMPERATURE SENSITIVE AUTOMOTIVE COMPONENTS

(75) Inventor: Andrew Zachary Glovatsky, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/553,205

(22) Filed: Apr. 20, 2000

Related U.S. Application Data

(60) Provisional application No. 60/130,860, filed on Apr. 22, 1998.

(51) Int. Cl.[7] ..... F01P 1/06
(52) U.S. Cl. ..... 123/195 C
(58) Field of Search ..... 123/195 C, 41.31, 123/195 E, 169 PH, 143 C, 184.61, 184.21

(56) References Cited

U.S. PATENT DOCUMENTS 4,893,590 A * 1/1990 Kashimura et al. ..... 123/41.31
5,715,140 A * 2/1998 Sinkunas et al. ..... 361/690
6,186,106 B1 * 2/2001 Glovatsky et al. ..... 123/143 C

* cited by examiner

*Primary Examiner*—Marguerite McMahon
*Assistant Examiner*—Hyder Ali
(74) *Attorney, Agent, or Firm*—Larry I. Shelton

(57) ABSTRACT

Positioning of sensitive electronics near the engine block is accomplished through the use of a heat shield providing for removal or diversion of transmitted heat from the block to the electronics through the use of a self-contained or externally circulated coolant fluid. Unlike conventional coolant channels in an engine block, the heat shield is not intended to cool the engine block and thus may be more compact insofar as it deals with lesser heat flux.

14 Claims, 3 Drawing Sheets

FLUID-COOLED HEAT SHIELD FOR TEMPERATURE SENSITIVE AUTOMOTIVE COMPONENTS

CROSS-REFERENCE TO RELATED APPLICATIONS

This application claims priority to Provisional Appln. No. 60/130,860, filed Apr. 22/1999.

STATEMENT REGARDING FEDERALLY SPONSORED RESEARCH OR DEVELOPMENT

Not Applicable

FIELD OF THE INVENTION

The present invention relates to electrical systems for automobiles and the like and, in particular, to a protective heat shield for protecting temperature sensitive electronic components from engine heat.

BACKGROUND OF THE INVENTION

Present day automobiles and other vehicles make use of sophisticated electronics for engine control and monitoring. Typically one or more microprocessor-based electronic control units collect engine data from sensors located in different points on the engine and about the engine compartment. The control unit executes a stored control program to produce control signals for actuators such as fuel injectors, throttle plate spark coils and the like.

The complex circuitry of the control units is temperature sensitive and thus may be mounted in a cooler portion of the engine compartment, typically against or within the firewall to provide the desired reliability of the electronics. A lengthy and complex wiring harness is necessary to communicate between the control unit and its associated sensors and actuators.

This wiring harness could be significantly shortened and simplified if the control modules could be moved to the engine. While in some cases it is possible to obtain high temperature components that may withstand engine temperatures, these parts can be unduly expensive, and high temperature versions of some components, such as electrolytic capacitors, are not readily available.

BRIEF SUMMARY OF THE INVENTION

The present invention provides a fluid cooled heat shield that permits proximate mounting of heat sensitive control electronics on or near the engine. The shield may be relatively compact because it is not intended to cool the engine but only to block a limited path of heat flow to the sensitive electronic components. By placing temperature sensitive control components in the "heat shadow" of the shield near the engine, wiring harnesses are reduced in length and simplified.

Specifically, the invention provides a system for protecting temperature sensitive vehicle electronics from engine heat by using a heat shield positioned, at least in part, between the control electronics and a high temperature engine component, wherein the heat shield includes a chamber holding a coolant fluid and providing a path of fluid circulation within the chamber for the removal of heat therefrom.

It is thus one object of the invention to provide a compact thermal barrier permitting sensitive electronics to be positioned close to the engine.

The chamber may include an inlet and outlet port and the coolant fluid may be an engine fluid, for example, transmission fluid, radiator fluid, ambient air or engine intake air, pumped through the chamber between the inlet port and the outlet port.

Another object of one embodiment of the invention is to provide a heat shielding system that may make use of cooling systems normally associated with the automotive engine.

In an alternative embodiment, the chamber may be sealed and include a radiating end having at least one fin and the fluid may be selected from those having vaporization temperatures below the temperature of the high temperature engine components so as together, with the chamber, to form a heat pipe.

Thus it is another object of the invention to provide self-contained heat shielding.

The heat shield may include a heat sink communicating between the control electronics and the chamber for transferring heat from the control electronics to the cooling fluid.

Thus it is another object of the invention to make additional use of the heat shield as a sink for heat generated by the electronics itself.

The foregoing and other objects and advantages of the invention will appear from the following description. In this description, reference is made to the accompanying drawings, which form a part hereof, and in which there is shown by way of illustration, a preferred embodiment of the invention. Such embodiment and its particular objects and advantages do not define the scope of the invention, however, and reference must be made therefore to the claims for interpreting the scope of the invention.

DETAILED DESCRIPTION OF THE INVENTION

Figure 1:
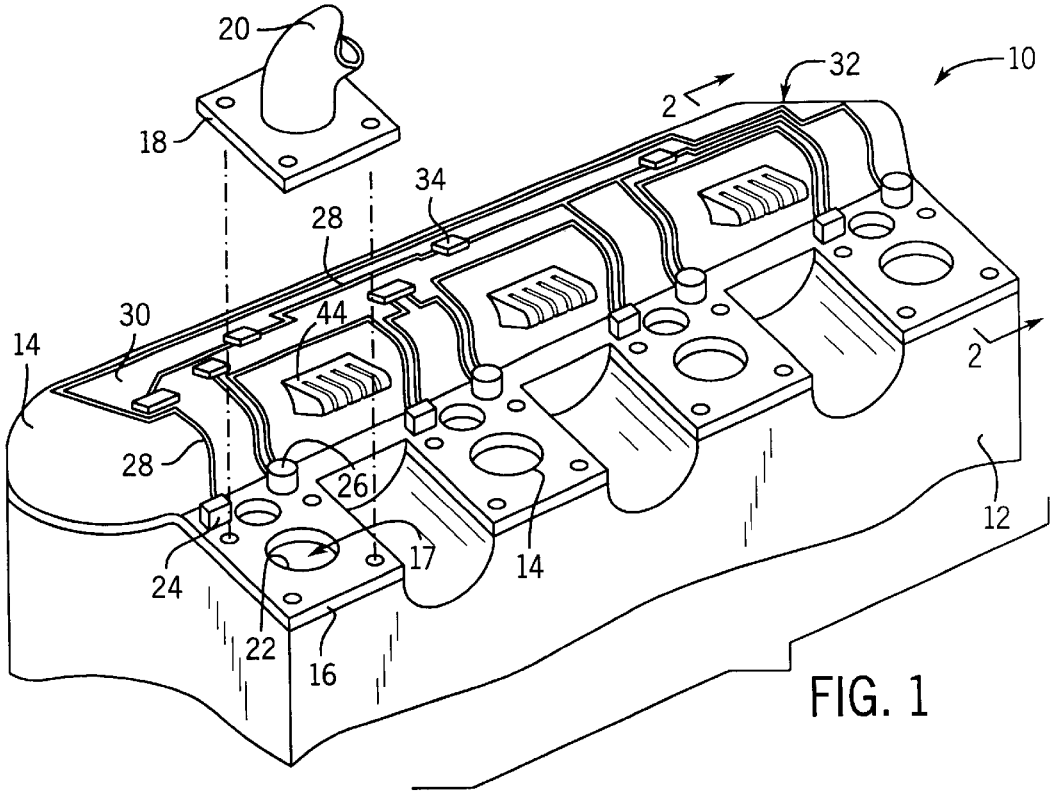
FIG. 1 is a perspective, fragmentary view of an example engine showing its intake ports and valve cover, the upper surface of which supports heat sensitive electronic components.

Referring now to FIG. 1, an engine 10 may include a block 12 holding therein cylinders and pistons (not shown) according to conventional engine design.

The upper surface of the block 12 may be covered by a valve cover 14 having tabs 16 extending outwardly over the intake ports 17 of the block 12 near the top of each cylinder. The tabs 16 include an aperture 22 through which inducted air may be drawn through the intake port 17 after passing through an intake valve of conventional design. In this regard, the tabs 16 fit beneath flanges 18 of intake manifold pipes 20 (only one shown) through which air is inducted according to well-understood techniques.

The tabs 16 support for each cylinder a spark coil 24 and injector 26 such as may communicate with the cylinder within the block 12 to provide control of fuel and ignition by conventional techniques. The injector 26 and spark coil 24 receive electrical signals through conductors 28 forming part of a flexible printed circuit substrate 30 attached to an upper surface 32 of the valve cover 14 and the top of the tabs 16.

The printed circuit substrate 30 may be any suitable material as is understood in the art. Further, the invention is not limited to use with a flexible printed circuit substrate 30 and similar wiring may be provided in any number of ways including use of free-standing harnesses or wiring attached directly to the valve cover 14 mechanically or by adhesive or in molded to the valve cover 14 or the like.

The tabs 16 provide a continuous structure connecting the valve cover 14 and the injectors 26 and spark coils 24 allowing unbroken support of the printed circuit substrate 30 or permitting conductors to be attached directly to upper surface 32 of the valve cover 14 and the tabs 16. In the alternative, short harnesses can be used to convey these electrical signals.

In the first depicted embodiment, the conductors 28 travel along the tabs 16 to the continuation of the flexible printed circuit substrate 30 on upper surface 32 of the valve cover where conductors 28 communicate with temperature sensitive electronic components 34. The temperature sensitive electronic components 34 provide engine control through signals communicated over conductors 28 to the spark coil 24 and injector 26 and possibly to or from other engine components located on or off of the flexible printed circuit substrate 30. Location of the temperature sensitive electronic components 34 in close proximity with the spark coils 24 and injectors 26 simplifies their interconnection.

Figure 2:
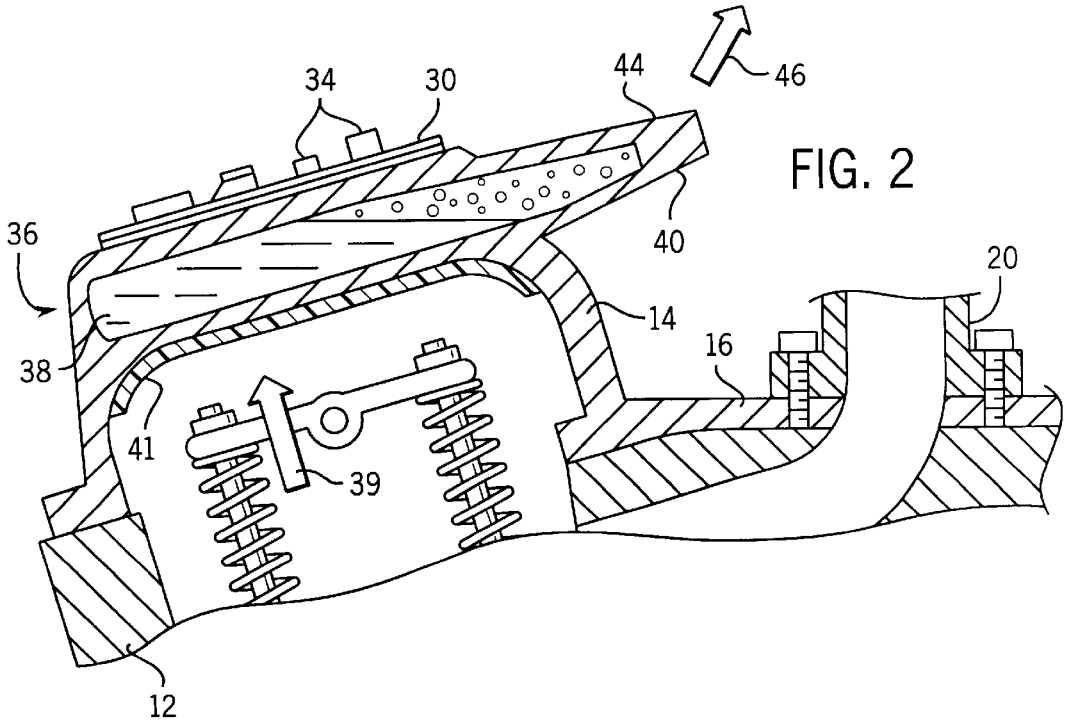
FIG. 2 is a cross-sectional view along line 2—2 of FIG. 1 showing a heat pipe incorporated into the valve cover for providing a heat shield between the heat sensitive electronic components and high temperature engine components.

Referring now to FIG. 2, the valve cover 14, per the prior art, covers the upper valve stems, valve springs and rocker arms. In the present invention, however, the valve cover 14 also provides, beneath its upper surface 32, a heat shield 36 positioned between the adjacent engine block 12 and the temperature sensitive electronic components 34 in the path of heat 39 passing from the block 12 toward the flexible printed circuit substrate 30.

The heat shield 36, in a first embodiment, includes a closed cavity 38 holding a volatile liquid with a vaporization point beneath the typical operating temperature of the block 12 such as a water antifreeze combination or a fluorinated hydrocarbon coolant. The cavity 38 has an upward cant toward a finned portion 40 having fin lamina 44 providing increased surface area in contact with the ambient air outside of the valve cover. Metal foams or fin metal inserts can be placed at the upper end of the cavity 38 to further improve heat transmission. The outer surface of the finned portion 40 may be treated with a high emissivity coating to further transmit heat in radiated form away from temperature sensitive electronic components 34.

The upward canting of the cavity 38 provides convective heat transfer from a portion of the heat shield 36 beneath the flexible printed circuit substrate 30 toward the finned portion 40 so that heat may be redirected along path 46 away from the temperature sensitive electronic components 34. The heat shield 36 thus allows close mounting of the temperature sensitive electronic components 34 to the valve cover 14 without the need for high temperature components or risk of damage to components from engine heat.

Some additional cooling of the valve cover 14 is provided by passage of air through manifold pipe 20. This air cools the manifold pipe 20 and tab 16 of valve cover 14 made integral therewith. By providing suitable conductive material in valve cover 14, improved heat shielding may be provided.

Because the purpose of the heat shield 36 is not to cool the engine block 12 but simply to prevent heat from passing to the temperature sensitive electronics 34, insulating material 41 may be placed between the heat shield 36 and the engine block 12 to enhance the shielding effect and reduce the size of the cavity 38 and finned portion 40.

By allowing temperature sensitive electronic components 34 to be located near the engine, wiring or conductors to the devices of injector 26 and coil 24 may be made shorter and free runs of wiring harness such as increase engine compartment clutter may be eliminated.

Figure 3:
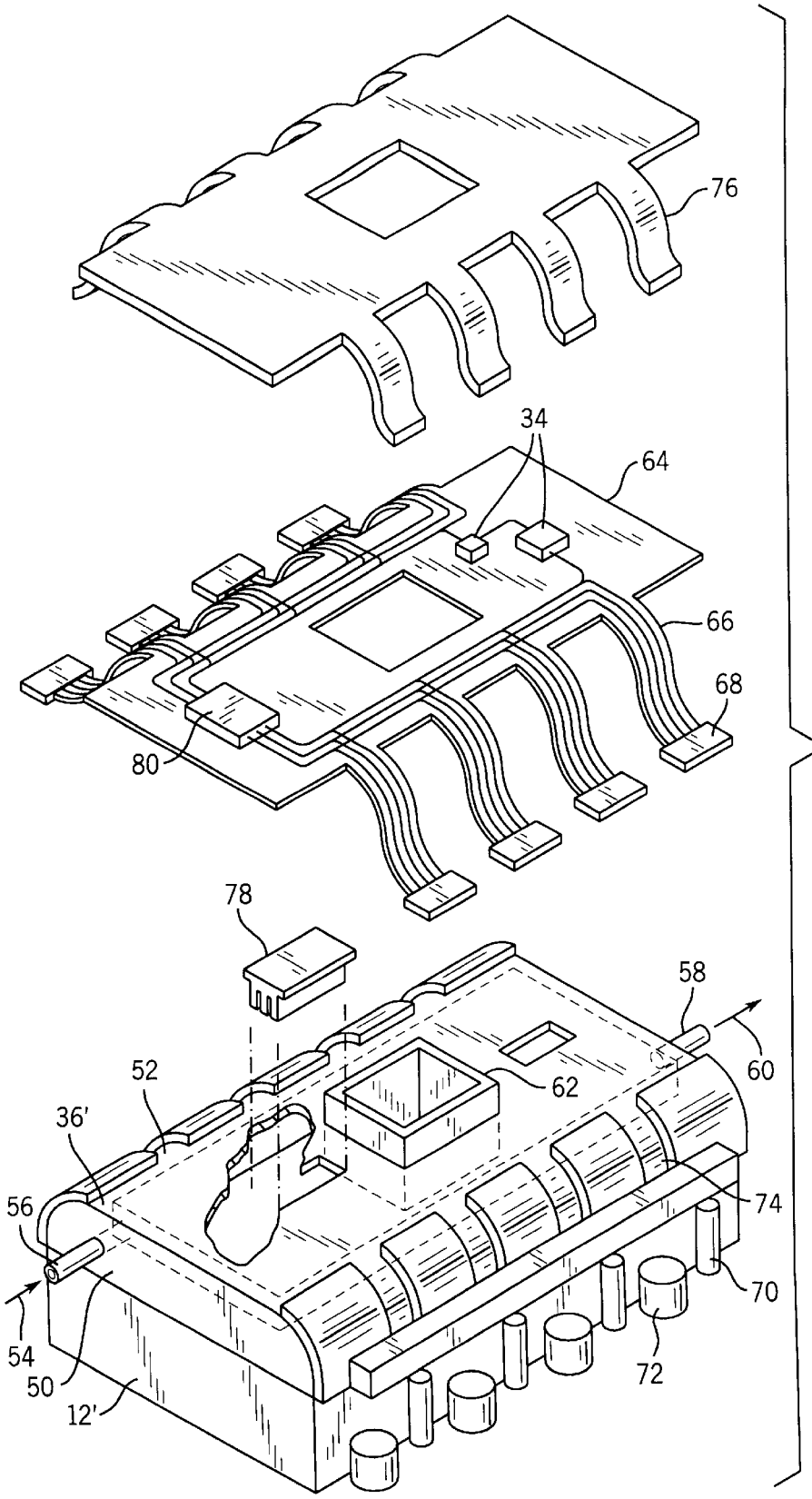
FIG. 3 is an exploded, perspective view of a second example engine having an intake manifold cover incorporating a chamber having inlet and outlet ports for circulation of cooling fluid and for thermally shielding electronics positioned on top of the manifold cover from heat from the engine.

Referring now to FIG. 3, a heat shield 36' need not employ a self-contained cooling medium but may make use of one of the coolant streams found in a conventional automobile.

In a first embodiment, the engine block 12' may be capped by an intake manifold assembly 50 incorporating standard intake manifold pipes (not shown) carrying inducted air to each cylinder. Positioned above these pipes is a chamber 52. The chamber 52 is isolated from the intake air but receives low temperature coolant 54 through an inlet pipe 56. The coolant passes through chamber 52 to absorb heat passing upward from the block 12' and then exits at outlet pipe 58 at an opposite wall of the chamber 52 as heated coolant 60. Barriers (not shown) may be inserted in the cavity to disrupt flow and cause better distribution of the coolant fluid within the cavity 38'. The coolant may be most conveniently radiator fluid but could also be circulated engine oil or transmission oil received from an engine oil cooler or transmission oil cooler or the like, or a dedicated coolant stream including ambient air and intake manifold air.

A central air intake 62 connects to the intake manifold pipes passing through the chamber 52 but isolated therefrom. The central air intake 62 provides additional cooling of the chamber 52 through its contained stream of cooled air. Likewise the pipes of the intake manifold block and absorb heat from the engine passing upward to the chamber 52.

On top of chamber 52 opposite the block 12', a flexible circuit substrate 64 may be placed holding temperature sensitive electronic components 34 and having sideward straps 66 communicating with connectors 68 which may connect to fuel injectors 70 and ignition coils 72 positioned on either side of the intake manifold assembly 50. The side straps 66 may lie within channels 74 in the intake manifold assembly 50' and be covered by a conforming cover 76 which also covers the main body of the flexible circuit substrate 64. Conforming cover 76 may include thermal insulation. In this way by enclosing the circuit substrate 64, the temperature of the ambient air does not define the lowest temperature that can be obtained.

Alternatively as described above, the temperature sensitive electronic components 34 may be applied directly to the top of the intake manifold assembly 50 by plating its surface with the necessary interconnect wiring or by in-molded or adhesively or mechanically attaching conductors to the intake manifold or by other methods known in the art. In all cases, the cooling is sufficient that conventionally rated electronic components can be used instead of high cost premium, high temperature components and substrates.

It is possible in yet another embodiment to place the circuit substrate 64 directly in the chamber 52 when protected by a suitable conformal coating.

Although the principal purpose of the chamber 52 is as a heat shield from the higher temperature of the engine block 12', heat sinks 78 may extend downward into the chamber 52 and have an upper surface that may abut a lower surface of flexible circuit substrate 64 beneath heat generating components 80 on the circuit substrate 64. In this way, heat generated by the components in the enclosed space between conforming cover 76 and the intake manifold assembly 50 may be drawn off by the same cooling fluid that blocks heat transmission from the block 12'.

Figure 4:
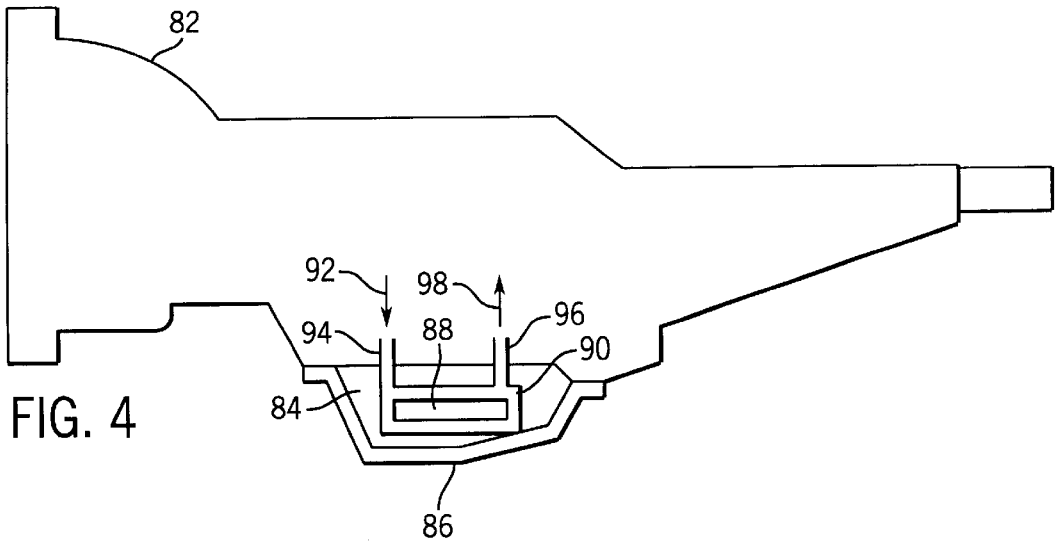
FIG. 4 is a cross-sectional view in outline of an example transmission showing a chamber similar to that of FIG. 3 positioned within the transmission sump for receiving cooling fluid to cool electronics contained in that chamber.

Referring now to FIG. 4, the present invention may be used with electronics mounted near other engine components, for example, a transmission 82. In this case, temperature sensitive circuit components 88 can be held in a transmission sump 84 held beneath a cover 86 at the bottom of the transmission 82. The temperature sensitive circuit components 88 are protected from heat by heat shielding chamber 90, which receives cooling fluid 92 through an inlet pipe 94, which may then be exhausted through an outlet pipe 96 as heated coolant fluid 98.

Figure 5:
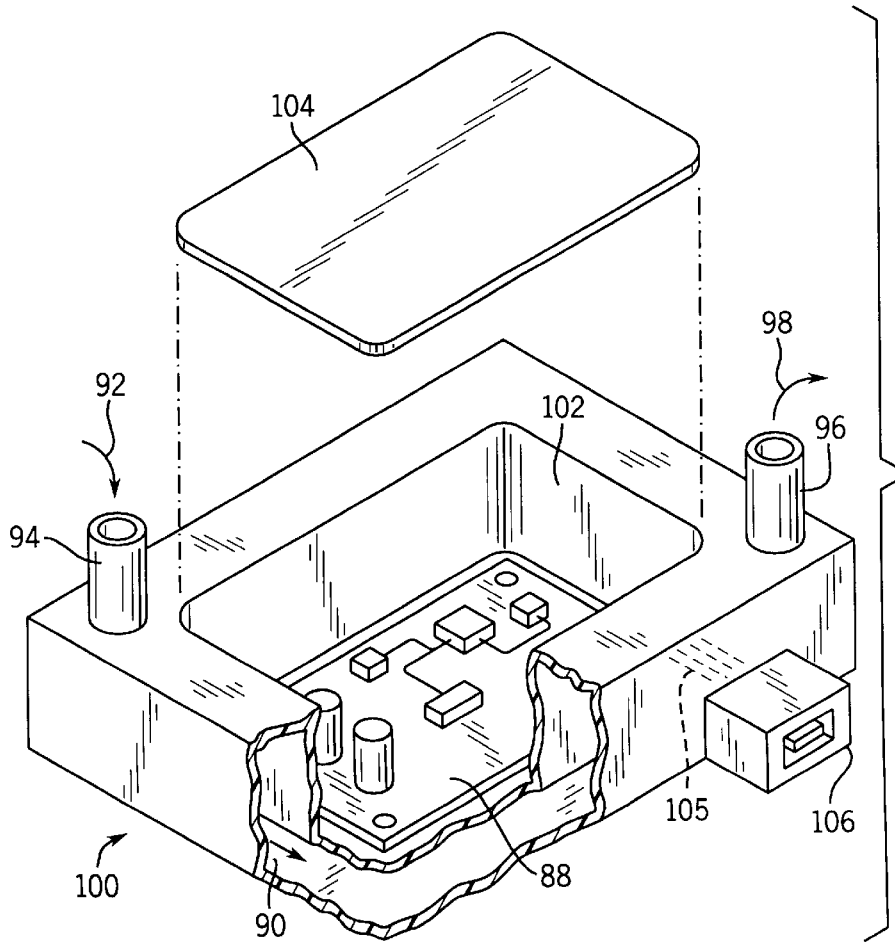
FIG. 5 is a cutaway perspective view of the chamber of FIG. 4 showing the chamber double wall for circulating cooling fluid around a center pocket holding the temperature sensitive electronics.

Referring also to FIG. 5, the temperature sensitive circuit components 88 are shielded from the coolant fluid by a double wall enclosure 100 providing for a central pocket 102 positioned beneath a sealable cover 104 isolated from coolant flow in the outer chamber 90. Here the coolant fluid may be transmission fluid or the like. Sealable access ports 105 may allow for conductors to be communicated into the temperature sensitive circuit components 88 through an external connector 106. Sufficient coolant flow through the outer chamber 90 may absorb heat passing through the cover 104 or cool the cover 104 by conduction or the cover 104 may be given a separate heat shield with coolant. The outer surfaces of the enclosure 100 may be thermally insulated (along with the cover 104). Further, the cover 104 may be reduced in area to reduce heat transmission therethrough for example by being positioned in a sidewall (as depicted) under the connector 106.

Although it is convenient to use the naturally occurring engine fluid for the coolant process in these latter examples, it will be understood that a specially circulated coolant may also be used having an independent radiator positioned elsewhere in the engine compartment.

It is specifically intended that the present invention not be limited to the embodiments and illustrations contained herein, but modified forms of those embodiments including portions of the embodiments and combinations of elements of different embodiments as come within the scope of the following claims.

I claim:

1. A heat shield for protecting vehicle electronics communicating with engine control devices, the heat shield comprising:

an electronics support attached to the engine holding the control electronics proximate to the engine control devices and near high temperature engine components;

a heat shield positioned at least in part between the engine control electronics and the high temperature engine components, the heat shield including:

(i) a chamber providing a path of fluid circulation through the heat shield and in thermal communication with a segregated air intake;

(ii) a cooling fluid contained at least in part within the chamber for circulation within the chamber and the removal of heat herefrom;

whereby the control electronics may be thermally isolated from the high temperature engine components.

2. The protective heat shield of claim 1 wherein the electronics support holds the control electronics within the chamber.

3. The protective heat shield of claim 2 wherein the chamber includes an inlet port and an outlet port and wherein the cooling fluid is an engine fluid pumped into the inlet port and out of the outlet port.

4. The protective heat shield of claim 3 wherein the engine fluid is selected from the group consisting of transmission fluid, radiator fluid, ambient air, and engine intake air.

5. The protective heat shield of claim 2 wherein the electronics support holds the control electronics within a transmission sump of the engine.

6. The protective heat shield of claim 2 wherein the chamber is sealed and includes a radiating end having at least one fin and wherein the fluid is selected to have a vaporization temperature below a temperature of the high temperature engine components so as together with the chamber to form a heat pipe.

7. The protective heat shield of claim 1 further including a heat sink communicating between the control electronics and the chamber for transferring heat from the control electronics to the cooling fluid.

8. The protective heat shield of claim 1 wherein the electronics support holds the control electronics on one side of the chamber.

9. The protective heat shield of claim 8 wherein the chamber includes an inlet port and an outlet port and wherein the cooling fluid is an engine fluid pumped into the inlet port and out of the outlet port.

10. The protective heat shield of claim 9 wherein the engine fluid is selected from the group consisting of transmission fluid, radiator fluid, ambient air and engine intake air.

11. The protective heat shield of claim 8 wherein the chamber is positioned on top of a valve cover and wherein the electronics support holds the control electronics on a far side of the chamber with respect to a remainder of the engine.

12. The protective heat shield of claim 8 wherein the chamber is positioned on top of an engine intake manifold and wherein the electronics support holds the control electronics on a far side of the chamber with respect to a remainder of the engine.

13. The protective heat shield of claim 8 wherein the chamber is sealed and includes a radiating end having at least one fin and wherein the fluid is selected to have a vaporization temperature below a temperature of the high temperature engine components so as together with the chamber to form a heat pipe.

14. The protective heat shield of claim 8 further including a heat sink communicating between the control electronics and the chamber for transferring heat from the control electronics to the cooling fluid.

* * * * *